US005171016A

United States Patent [19]

Kamal

[11] Patent Number: 5,171,016

[45] Date of Patent: Dec. 15, 1992

[54] APPARATUS FOR PRACTICING PUTTING AND CHIPPING

[76] Inventor: Charles J. Kamal, 166 S. Lincoln St., Keene, N.H. 03431

[21] Appl. No.: 803,680

[22] Filed: Dec. 3, 1991

Related U.S. Application Data

[63] Continuation of Ser. No. 713,049, Jun. 10, 1991, abandoned, which is a continuation of Ser. No. 506,629, Apr. 9, 1990, abandoned.

[51] Int. Cl.[5] ..... A63B 67/02

[52] U.S. Cl. ..... 273/176 F; 273/DIG. 30; 273/176 FB; 273/179 R

[58] Field of Search ..... 273/176 R, 176 L, 178 R, 273/178 B, 179 R, 122 R, 195 R, 195 A, 195 B, DIG. 30, 182 R, 182 A

[56] References Cited

U.S. PATENT DOCUMENTS

| | | | |
|---|---|---|---|
| 1,582,183 | 4/1926 | Maurer | 273/176 H |
| 1,582,237 | 4/1926 | Angell | 273/176 F |
| 2,710,755 | 6/1955 | Craig | 273/122 R |
| 3,323,802 | 6/1967 | Riner | 273/176 E |
| 3,414,266 | 12/1968 | Mitchell | 273/176 J |
| 3,669,454 | 6/1972 | Kolonel | 273/176 F |
| 3,727,918 | 4/1973 | Zawacki | 273/176 FB |
| 3,856,313 | 12/1974 | Tierney | 273/176 FB |
| 3.861,524 | 1/1975 | Coleman | 273/176 FB X |
| 3,885,795 | 5/1975 | Brewer | 273/176 E |
| 3,936,055 | 2/1976 | Scott | 273/176 H |
| 3,944,232 | 3/1976 | Tierney | 273/176 FB |
| 3,990,573 | 11/1976 | Cross | 273/176 FB |
| 4,634,130 | 1/1987 | Simjian | 273/176 FA |
| 4,877,250 | 10/1989 | Centafanti | 273/176 FB |
| 4,978,127 | 12/1990 | Juel | 273/176 H |
| 5,069,455 | 12/1991 | Thomas | 273/176 H |

FOREIGN PATENT DOCUMENTS

| | | | |
|---|---|---|---|
| 707825 | 6/1931 | France | 273/176 F |
| 1196165 | 11/1959 | France | 273/176 F |
| 563781 | 7/1975 | Switzerland | 273/176 J |
| 358362 | 10/1931 | United Kingdom | 273/176 F |
| 1073847 | 6/1967 | United Kingdom | 273/179 R |
| 2042347 | 9/1980 | United Kingdom | 273/176 J |

*Primary Examiner*—William H. Grieb
*Assistant Examiner*—Sebastiano Passaniti
*Attorney, Agent, or Firm*—Hale and Dorr

[57] ABSTRACT

Disclosed is a portable putting and chipping practice apparatus that includes a platform comprised of two portions connected by a hinge. A removable putting surface, preferably made of a carpet-type material, is secured to the top surface of the apparatus. A hole is placed through the surface near one end of the platform, and a backboard surrounds that end of the apparatus. A gutter, which is embedded along the top edges of the apparatus, collects golf balls and is sloped to cause the golf balls to reutrn to the golfer. Under the hole, an embedded tunnel leads golf balls entering the hole back towards the golfer striking the golf ball. The line or speed of the putts may be adjusted by placing small blocks under a side of the apparatus. The golfer may also practice putts of different speeds by replacing the surface material with a material of a finer or heavier cut.

8 Claims, 4 Drawing Sheets

APPARATUS FOR PRACTICING PUTTING AND CHIPPING

This is a continuation of co-pending application Ser. No. 07/713,049 filed on Jun. 10, 1991, now abandoned which was a continuation of Ser. No. 07/506,629 filed on Apr. 9, 1990, now abandoned.

BACKGROUND OF THE INVENTION

The present invention relates to an apparatus for use in practicing the putting and chipping of a golf ball, and more particular to a portable apparatus for practicing putting and chipping which is adjustable to simulate a wide range of putting and chipping conditions.

The constant practice of various golf strokes is an absolute necessity for golfers, especially those who play on a competitive basis. Putting and chipping are two particular types of strokes that require the golfer to obtain a certain "feel" and that "feel" can only be obtained and maintained through practice. A variety of circumstances, such as rain, snow, cold or darkness, however, prevent or inhibit practice for days and even weeks.

Since putting and chipping can be practiced on a smaller area than is required for practicing other golf shots, many practice putting units have been developed. Many of these units, however, elevate the "hole" area so that golf balls that are hit to the hole must first strike a raised area around the hole. Frequently before the hole area is reached the ball jumps and shifts direction before entering the hole. This obviously creates an effect that is not encountered on a genuine putting green.

Another problem associated with the practice of putting with known apparatus is that the line of putt is always constant. In other words, such devices are traditionally placed on flat carpeted floors which prevents the golfer from ever being forced to hit a putt that follows a curved path to the hole. In addition, on a flat floor of one constant surface (such as carpet) the speed of the putt is always the same. These two factors obviously prevent indoor practice from being of much value to a golfer who is faced with greens with a variety of contours and speeds on a golf course.

It is therefore a principal object of the present invention to provide a portable practice putting and chipping apparatus for use by golfers.

A further object of the present invention is to provide a portable practice putting and chipping apparatus that recreates actual putting environments.

Still another object of the present invention is to provide a portable practice putting and chipping apparatus that is adjustable to allow the golfer to practice putts of various speeds and slopes.

SUMMARY OF THE INVENTION

The portable putting and chipping practice apparatus of the present invention includes a platform which is comprised of two portions connected by a hinge. A removable putting surface, preferably made of a carpet-type material, is secured to the top surface of the apparatus. A hole is placed through the surface near one end of the platform, and a backboard surrounds that end of the apparatus. A gutter, which is embedded along the top edges of the apparatus, collects golf balls and is sloped to cause the golf balls to return to the golfer. Under the hole, an embedded tunnel leads golf balls entering the hole back towards the golfer striking the golf ball.

The line or speed of the putts may be adjusted by placing small blocks under a side of the apparatus. The golfer may also practice putts of different speeds by replacing the surface material with a material of a finer or heavier cut.

These and other objects and features of the present invention will become apparent to those skilled in the art when considered in view of the following detailed description which should be read in light of the accompanying drawings in which corresponding reference numerals refer to corresponding parts throughout the several views.

DETAILED DESCRIPTION OF THE PREFERRED EMBODIMENTS

Figure 1:
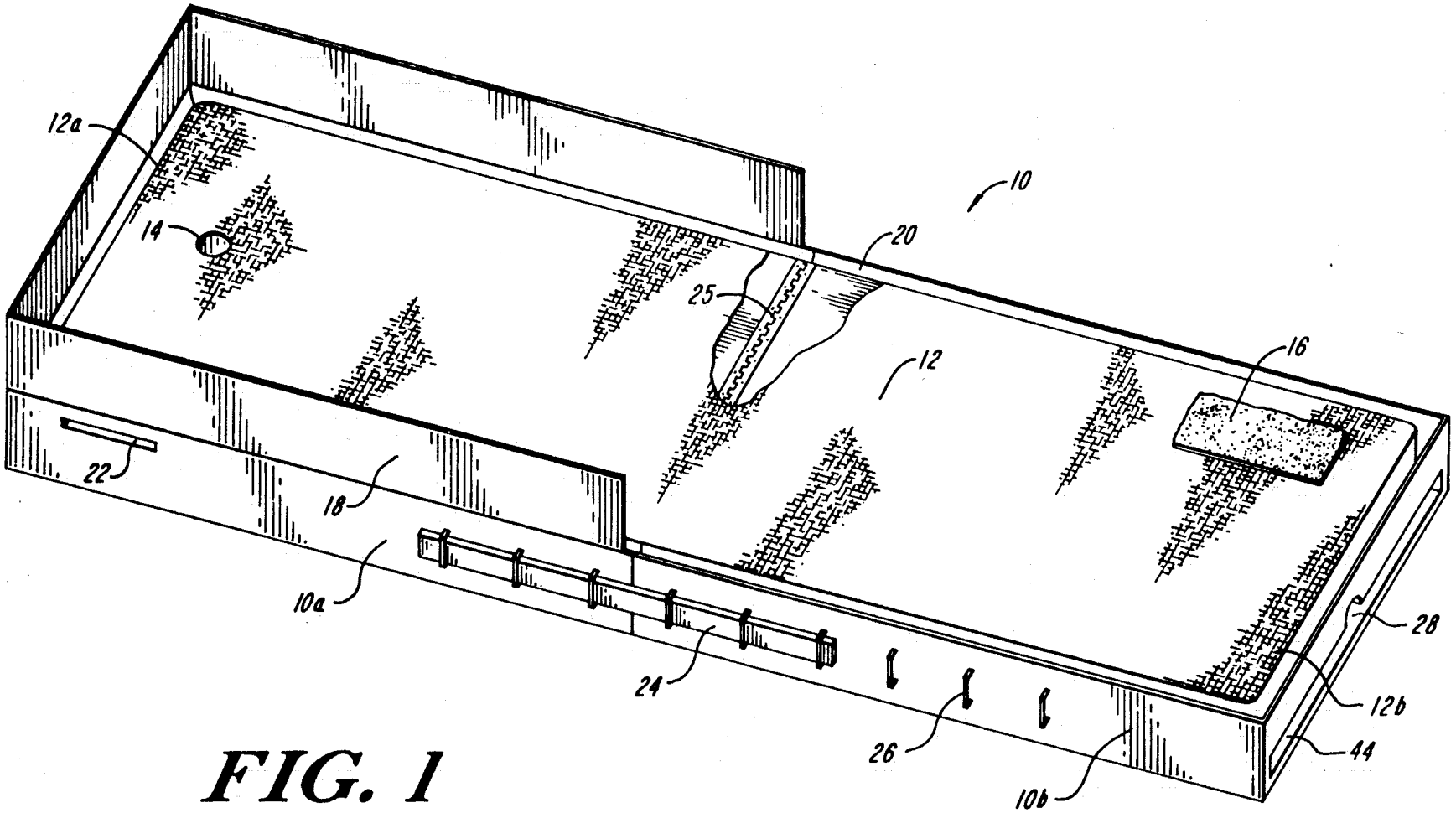
FIG. 1 is a top perspective view of the practice putting and chipping apparatus of the present invention.
Figure 2:
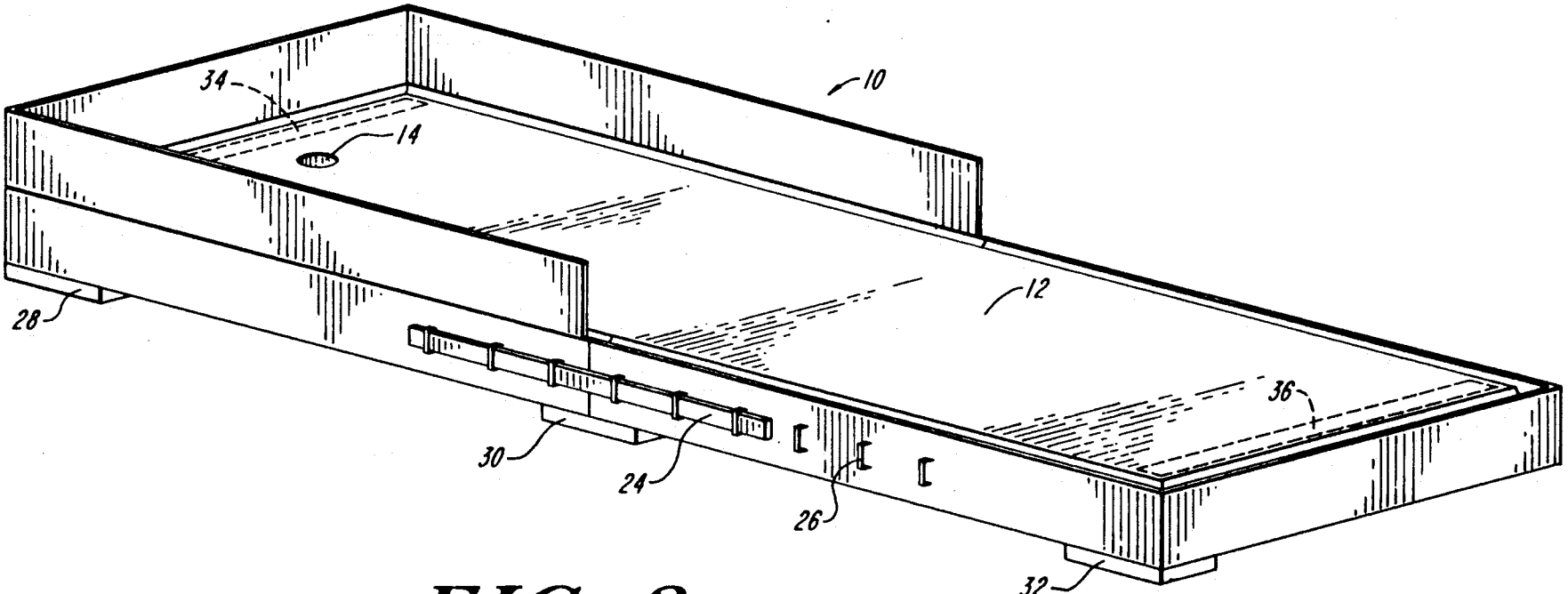
FIG. 2 is a side perspective view of the practice putting apparatus shown in FIG. 1.

The practice putting and chipping apparatus 10 of the present invention is shown in FIGS. 1 and 2 in an open position ready for use. The top surface 12 of the putting apparatus 10 in a preferred embodiment is a carpet type material that is spread over the entire flat top surface of the putting apparatus. The surface material 12 is selected to recreate the putting environment of a golf ball on a green having a particular type of grass. If a different speed of roll of the golf ball is desired, as is needed to practice putting on different types of grass, a different top surface layer 12 (preferably of another type of carpet) is placed on the top surface of the putting apparatus. Flexible materials resembling an artificial grass-like ground covering sold under the trademark Astroturf may also serve as the surface layer 12.

A standard United States Golf Association size hole 14 is embedded near one end 12*a* of the top surface 12 of the putting apparatus. At the opposite end 12*b* of the top surface 12 a small astroturf-type mat 16 is placed to allow the golfer to practice chipping. This mat is removable, and in fact may be taken off the top surface and placed at a location off the apparatus to allow for chipping at greater distances.

A backboard 18 is positioned around end 12*a* of the putting apparatus in order to deflect golf balls which would otherwise travel off the surface of the apparatus. The golf balls striking the backboard 18 are deflected into a surface gutter 20 which surrounds the putting surface. The backboard 18 is removable and fits into a recess 22 in the walls of the putting apparatus.

In order to allow the putting apparatus 10 to be easily stored and transported, it is divided into two portions 10*a* and 10*b* which are connected by hinge 25. The hinge 25 is shown in FIG. 1, but the hinge would generally not be seen by the golfer as it would be covered by the putting surface 12. Hinge 25 is positioned below the surface line of the sections 10*a* and 10*b* so as to avoid creating any unnatural obstructions (such as a bump) in the putting surface.

A slide bolt 24 slides through brackets 26 that are positioned along the side walls of each portion 10*a* and 10*b*. This slide bolt 24, which is located at the same location on opposite sides of the putting apparatus, keeps the putting surfaces of the two portions parallel, especially when the apparatus is used to recreate a slope in a green.

Figure 3:
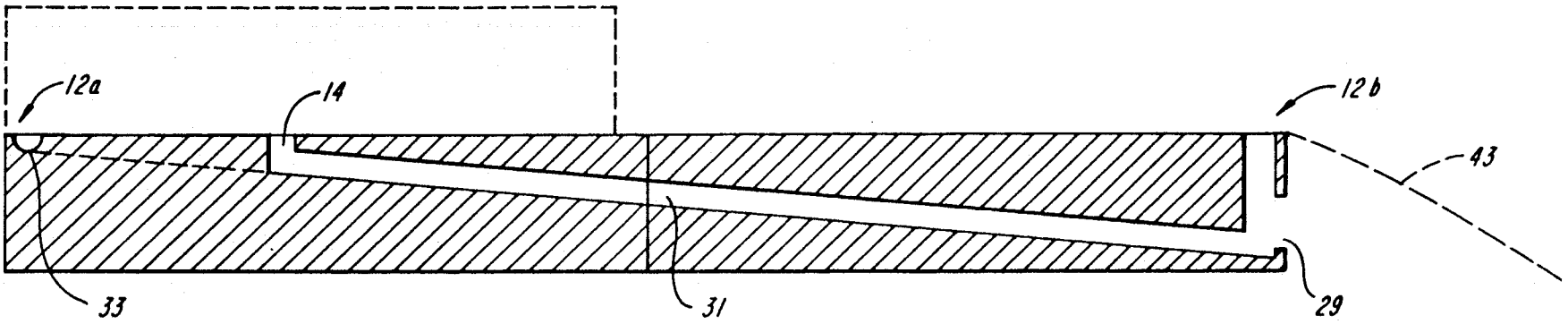
FIG. 3 is a side sectional view of the practice putting and chipping apparatus taken along lines 3—3 of FIG. 1.

Referring to FIG. 3, golf balls which enter hole 14 return to either end of the apparatus 10 by traveling through a tunnel 31 under the surface of the apparatus. The balls then collect in embedded lower gutters 44 (shown only in FIG. 1) at either end. Golf balls enter the gutter 20 through hole 14 in the top surface of the apparatus.

The surface gutter 20 is constructed so that it is a rather shallow gutter at the end 12*a* of the apparatus near the hole and becomes a deeper gutter closer to the end 12*b* of the apparatus so as to create a natural slope in the gutter to cause the golf balls to collect at the end 12*b* of the apparatus. This helps prevent the end 12*a* of the apparatus from being cluttered with too many golf balls and allows the putter to practice for a longer period of time before collecting the balls.

Referring back to FIG. 2, a slope in the putting green can be created by placing blocks 28, 30, 32 under one side of the apparatus in order to elevate that side. The slide bolt 24 when positioned in the stabilized brackets 26 in both portions 10*a* and 10*b* secures the apparatus and prevents it from folding when an end or side is elevated. Instead of blocks, elevating mechanisms could be placed under the platform 10 along the sides and ends of the apparatus at the locations where the blocks would be positioned. Such elevating mechanisms could be selectively activated.

Fastening tape strips 34, 36 comprising hook and loop fasteners of the type sold under the trademark Velcro which would normally not be seen, are positioned beneath the surface material 12 in order to secure that material. By securing both ends of the surface material 12, the surface material can be stretched slightly to prevent any irregularities in contour due to looseness or bulging.

Referring again to FIG. 3, the embedded tunnel 31 is slightly pitched from the hole 14 to the end 12*b* of the apparatus. This allows all of the golf balls entering the hole 14 to collect at the end 29 of the embedded gutter 31, making it easier for the golfer to collect the golf balls. In the event that the apparatus is elevated to create a downhill putt, the golf balls would collect at the end 33 of the embedded gutter.

An optional deflector board shown in dashed line 43 may be attached to end 12*b* of the apparatus when chipping in order to prevent a sculled or bladed chip shot from bouncing back off the apparatus.

Figure 4:
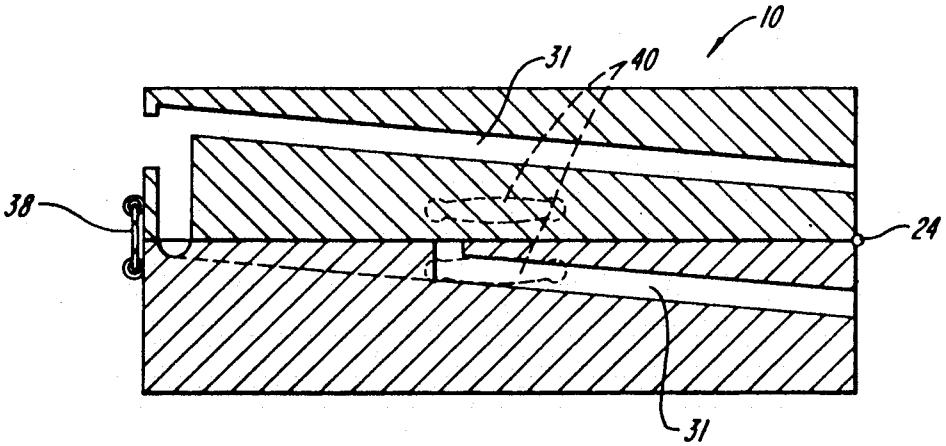
FIG. 4 is a side sectional view of the practice putting and chipping apparatus of FIG. 1 taken along lines 3—3 of FIG. 1 with the unit in a folded-up position.

Referring now, to FIG. 4, the apparatus is shown in a folded state. The hinge 25 continuously secures one end of the apparatus 10 while a latch hook 38 secures the other end of the apparatus. The apparatus 10 is easily picked up by handles 40 and stored out of the way when not in use.

Figure 5:
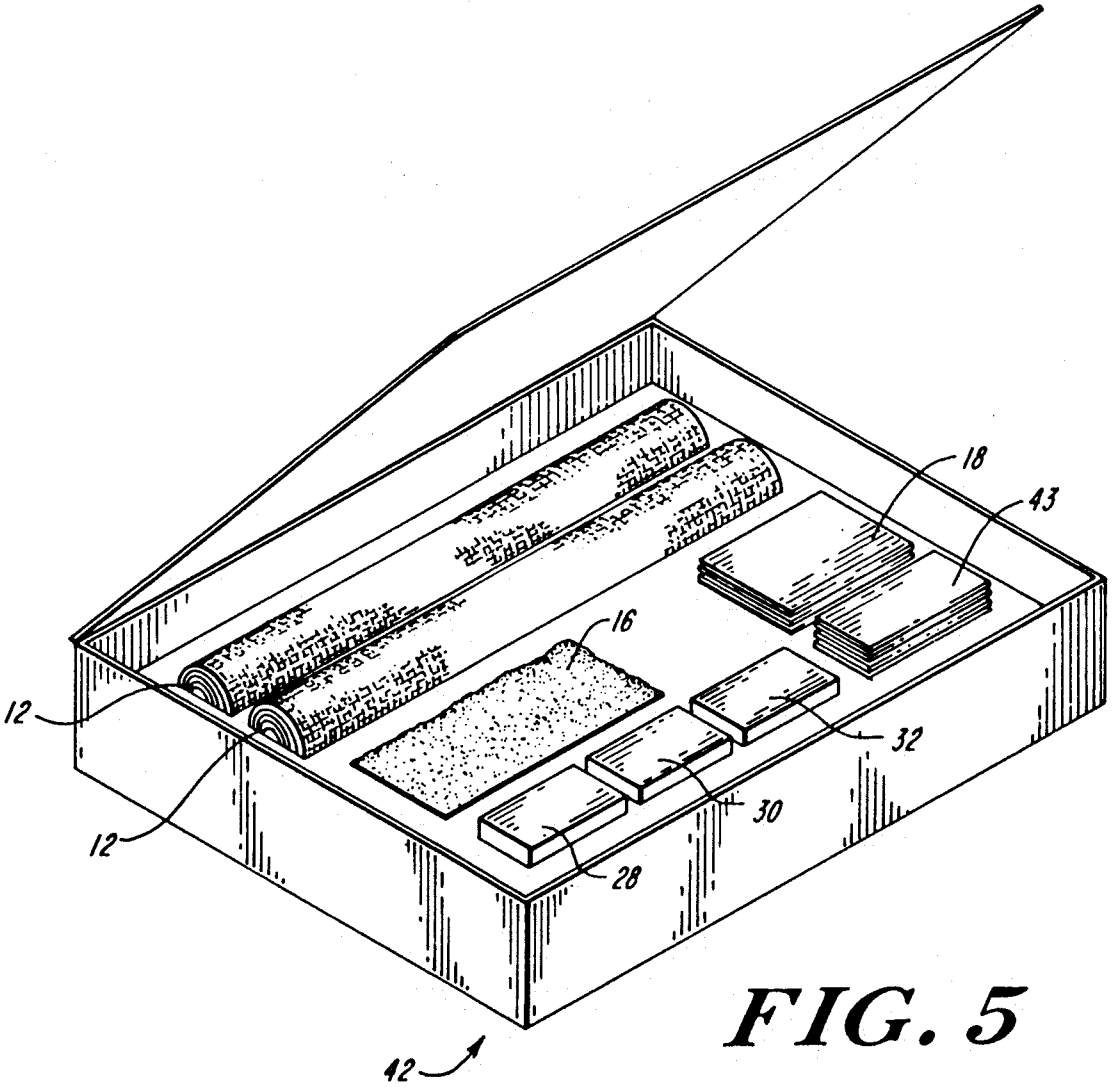
FIG. 5 is a perspective view of the carrying case for the various replaceable elements for the practice putting and chipping apparatus of FIG. 1.

Before folding the putting apparatus 10, the putting surface 12 is pulled off the velcro strips 34, 36 and rolled into a cylinder shape and stored in a storage unit 42 as shown in FIG. 5. A number of putting surfaces 12, each with a different surface contour, may be stored in unit 42 in order to allow the golfer to provide for various speed adjustments. The backboard 18 can be folded and stored in the storage unit 42 as are the astroturf mat 16, deflector board 43, and the small blocks 28, 30 and 32.

The putting and chipping apparatus described above enables a golfer to putt a ball which will freely enter a hole, without any distortions in its travel path. In addition, as the putting surface is interchangeable, the golfer can practice putts at various speeds, thereby allowing the golfer to practice under the very conditions under which he may compete by simply measuring the speed of the putting greens he will be putting on, and then finding a matching rug type surface in his collection and placing it on the apparatus. The user can also improve his ability to make sidehill, uphill and downhill putts by creating a slope with the apparatus. In addition, the use of the backboard makes the apparatus more practical for chipping as it catches the golf balls and prevents any damage, especially when used indoors. Finally, since the device is portable it can be used indoors and outdoors, and it can be transported while traveling and easily set up in a motel room, thereby allowing the golfer to practice any time and anywhere.

While the foregoing invention has been described with reference to its preferred embodiments, various alterations and modifications may occur to those skilled in the art. All such modifications and alterations are intended to fall within the scope of the appended claims.

What is claimed is:

1. A portable practice putting and chipping apparatus comprising;

a platform having a top surface on which a user may stand when using the apparatus, said platform having a hole embedded in said top surface into which golf balls can enter, said platform being comprised of at least two portions each having a top surface;

means for securing said two portions so that said top surfaces of said at least two portions are parallel to each other when the apparatus is in use;

at least two removable interchangeable putting surfaces, each of said interchangeable putting surfaces simulating a different actual putting green surface, each of said interchangeable putting surfaces being shaped to lie only on said top surface of said platform;

a continuous gutter embedded in said top surface of said platform along edges of said top surface said platform and extending along the entire length of the apparatus from an end of the apparatus near said hole to an end of the apparatus on which the user stands.

2. The portable practice putting and chipping apparatus of claim 1 and further comprising:

a tunnel positioned within said platform under said top surface of said platform and running along a longitudinal axis of said platform from one end of said platform on which the user stands when using the apparatus to an opposite end of said platform closest to said hole, said tunnel also including an entrance port leading from said hole into said tunnel.

3. The portable practice putting and chipping apparatus of claim 1 wherein each of said at least two portions is connected to an adjacent portion by a hinge, said hinge being secured to each of said at least two portions so that the hinge lies below a surface level of said at least two portions when said at least two portions are lying side-by-side.

4. The portable practice putting and chipping apparatus of claim 1 further comprising means for elevating an end of said platform to change the slope of said tope surface of said platform.

5. The portable practice putting and chipping apparatus of claim 1 further comprising a backboard positioned along walls of at least one of said at least two portions of said platform to prevent balls from travelling off either one of said putting surfaces.

6. The portable practice putting and chipping apparatus of claim 1 wherein each of said putting surface is securable to said platform by hook and eye fastener strips positioned on said top surface of said platform.

7. The portable practice putting and chipping apparatus of claim 1 further comprising a removable deflector board attached to one end of the apparatus so as to provide an incline from a floor upon which the apparatus is positioned to the top surface of the platform.

8. A portable practice putting and chipping apparatus comprising:

a platform having a top surface on which a user may stand when using the apparatus, said platform having a hole embedded in said top surface into which golf balls can enter, said platform being comprised of at least two portions each having a top surface;

means for securing said two portions so that said top surface of said at least two portions are parallel to each other when the apparatus is in use;

at least two removable interchangeable putting surfaces, each of said interchangeable putting surfaces simulating a different actual putting green surface, each of said interchangeable putting surfaces being shaped to lie only on said top surface of said platform;

a gutter embedded in said top surface of said platform extending along the entire length of the apparatus from an end of the apparatus near said hole to an end of the apparatus on which the user stands, said gutter having a greater depth at one end of said platform with the depth of said gutter decreasing gradually from said end of said platform with a gutter of greater depth to an end of said platform with a gutter a lesser depth.

* * * * *